US006655936B2

(12) United States Patent
Szeszulski et al.

(10) Patent No.: US 6,655,936 B2
(45) Date of Patent: Dec. 2, 2003

(54) ROTARY VANE PUMP WITH UNDER-VANE PUMP

(75) Inventors: Joseph T. Szeszulski, Flushing, MI (US); Michael Edward Thurlow, Bay City, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/990,795

(22) Filed: Nov. 14, 2001

(65) Prior Publication Data

US 2003/0091452 A1 May 15, 2003

(51) Int. Cl.[7] ..... F04C 2/344

(52) U.S. Cl. ..... 418/82; 418/132; 418/133; 418/135; 418/268

(58) Field of Search ..... 418/82, 132, 133, 418/135, 268

(56) References Cited

U.S. PATENT DOCUMENTS 3,216,363 A * 11/1965 Snow et al. ..... 418/135
3,822,965 A * 7/1974 Drutchas et al. ..... 418/133
4,386,891 A * 6/1983 Riefel et al. ..... 418/82
6,050,796 A * 4/2000 Wong et al. ..... 418/133

* cited by examiner

*Primary Examiner*—John J. Vrablik
(74) *Attorney, Agent, or Firm*—Michael D. Smith

(57) ABSTRACT

A vane pump including a rotating group comprising a thrust plate and a pressure plate which cooperate with a cam ring, rotor and vanes to provide a plurality of pump chambers. The thrust plate includes a pair of thrust plate passageways. Each thrust plate passageway comprises a pair of kidney shaped passages. The first kidney shaped passage is radially aligned with the discharge port of the thrust plate. The second kidney shaped passage is radially aligned with the inlet port of the thrust plate. The first and second kidney shaped passages are connected with a metering groove. Each thrust plate passage is isolated or blocked from the next adjacent thrust plate passage in the low-to-high pressure transition area of the thrust plate.

10 Claims, 3 Drawing Sheets

ROTARY VANE PUMP WITH UNDER-VANE PUMP

TECHNICAL FIELD

The present invention relates to hydraulic vane type pumps and, more particularly, to such pumps having under-vane pressure to assist vane extension.

DESCRIPTION OF THE PRIOR ART

Prior art power steering pumps have provided an exclusive flow path for the under-vane fluid in a vane type pump to improve cold priming. This exclusive flow path is from under the vanes in the pressure or discharge quadrant through a groove in the thrust plate to under the vanes in the inlet quadrant. The pressure plate has a groove in the inlet quadrant, which communicates the under-vane fluid in the inlet quadrant with the discharge flow of the pump. While this structure provides fast priming, it also induces high under-vane pressure when the system operating temperature is at the normal level, and the pump is operating within the normal speed range. This high under-vane pressure can induce early wear and reduces the overall life of the pump.

Further, in other prior art pumps, at particular operating conditions, the centrifugal force acting on the vanes is inadequate to insure the vane remains in contact with the internal contour of the pump ring. At all pump speeds, the pump outlet pressure in the high pressure area of the ring discharge is equal to the under-vane pressure which results in a floating vane condition at the ring contour. If a vane pump is operating at a relatively low speed, an external pressure can equalize or overcome the centrifugal force on the vanes and resulting under-vane pressure. This situation results in a reduced pumping efficiency along with noises from the floating vane condition.

Another prior art assembly disclosed in U.S. Pat. No. 4,386,891 to Riefel, et al discloses a rotary hydraulic vane pump with under-vane passage for assisting in priming. This assembly includes grooves in the thrust and pressure plates with the groove in the pressure plate being in communication with the discharge flow of the pump. The grooves incorporate restrictions to the under-vane fluid flow between the discharge and inlet positions of the vanes with the restriction in the thrust plate permitting more fluid flow than the restriction in the pressure plate to insure that most of the fluid will pass through the rotor under the vanes in the inlet to assist in vane extension. The grooves on the pressure plate are also isolated from one another in the direction of the low-to-high pressure transition.

SUMMARY OF THE INVENTION

The present invention provides a vane pump comprising a housing. The vane pump further comprises a rotating group including a ported thrust plate seated on the housing. The ported thrust plate includes a pair of thrust plate passageways thereon. The rotating group further includes a ported pressure plate having a pair of pressure plate passageways thereon. The rotating group also includes a cam ring disposed between the pressure plate and the thrust plate. The vane pump further comprises an oval-shaped wall on the cam ring cooperating with the pressure plate and the thrust plate to define a rotor chamber in the rotating group.

The vane pump further comprises a rotor supported in the rotor chamber for rotation about a longitudinal axis of the vane pump. The vane pump further includes a plurality of radial vane slots in the rotor. Each of the vane slots defines an under-vane cavity. The thrust plate passageways and the pressure plate passageways are axially aligned with the under-vane cavities. The vane pump further comprises a plurality of flat vanes slideable in respective ones of said vane slots. Each of the thrust plate passageways includes two generally kidney-shaped passages joined by a restricted passage. Each of the thrust plate passageways is isolated from fluid communication with the next adjacent thrust plate passage.

It is, therefore, an object of the present invention to provide an under-vane pump separating the low-to-high pressure regions of the vane pump. This is accomplished by closing the low-to-high pressure transition in the thrust plate.

BRIEF DESCRIPTION OF THE DRAWINGS

This and other objects and advantages of the present invention will be readily appreciated as the same becomes better understood by reference to the following detailed description when considered in connection with the accompanying drawings wherein.

DETAILED DESCRIPTION OF THE DRAWINGS

Figure 1:
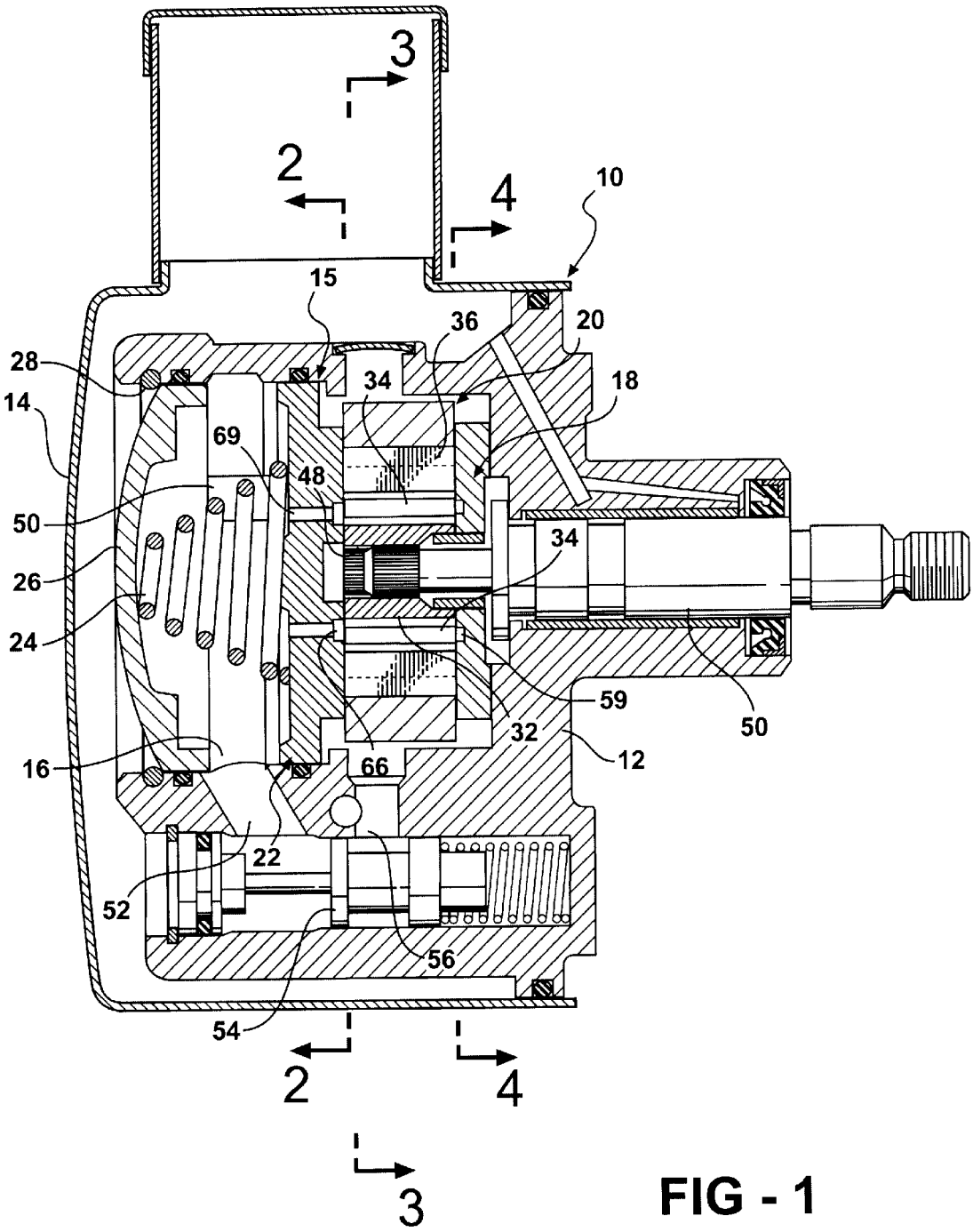
FIG. 1 is a cross-sectional elevational view of a power steering pump.
Figure 2:
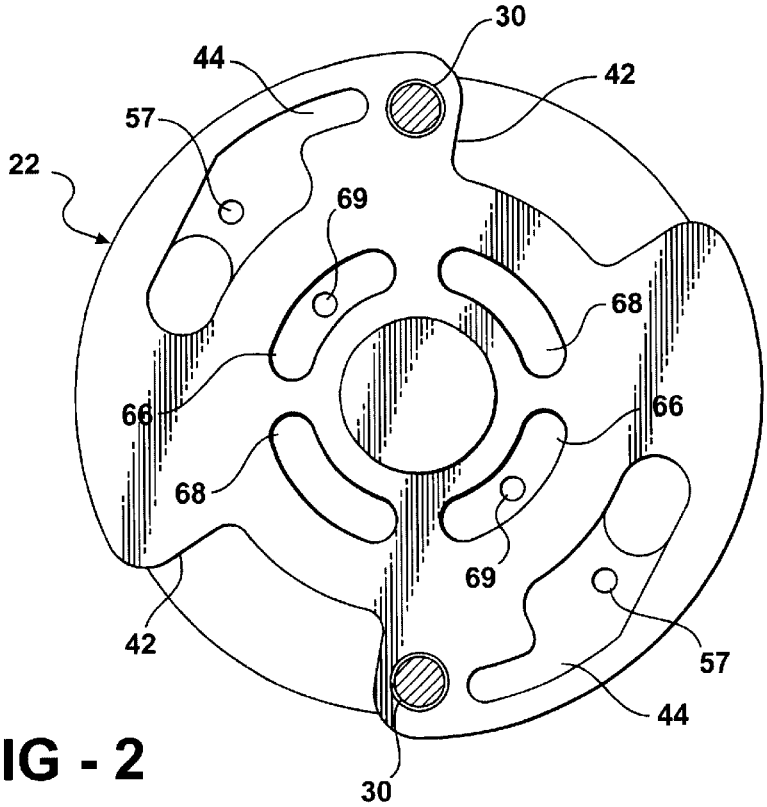
FIG. 2 is a sectional view taken along lines 2—2 of FIG. 1.

A power steering pump is generally indicated at 10 in FIG. 1. The pump 10 includes a housing 12 and a cover 14. The housing 12 has a substantially cylindrical inner space 16 in which is disposed a rotating group generally indicated at 15. The rotating group comprises a thrust plate or first plate 18, a cam ring 20, and a pressure plate or second plate 22. The rotating group 15 is stationary relative to the housing 10. The components of the rotating group are shown in more detail in FIGS. 2 through 4.

A hold-down spring 24 and end cap 26 are also provided. The end cap 26 is restrained in the housing by a locking ring 28. The thrust plate 18, cam ring 20, and pressure plate 22 are maintained in axial and angular alignment by a pair of dowel pins 30 which extend from openings (not shown) in the housing 12 to the end cap 26. That is, the dowel pins 30 prevent relative rotation between the thrust plate 18, cam ring 20 and pressure plate 22 about a longitudinal axis of the vane pump 10. A rotor 32 is rotatably disposed within an oval-shaped opening in a cam ring 20. The oval-shaped opening defines a rotor chamber in the rotating group 15. More specifically, the rotor chamber is defined by the oval-shaped opening in the cam ring 20, the thrust plate 18 and pressure plate 22. The thrust plate 18 and the pressure plate 22 close the axial ends of the oval shaped opening.

The rotor 32 has a plurality of vanes slots 34 therein. The vane slots 34 extend radially on the rotor. Each vane slot 34 has vane member 36 slideably disposed therein. Each vane member 36 is adapted to move radially outwardly of the slot 34 to engage the inner surface 37 of the cam ring 20 such that a fluid chamber is formed between adjacent of the vane members 36. In this manner, the vane members or vanes 36 form the fluid chambers which expand in each of a pair a diagonally opposite inlet sectors and collapse in each of a pair of diagonally opposite discharge sectors in conventional fashion.

Figure 3:
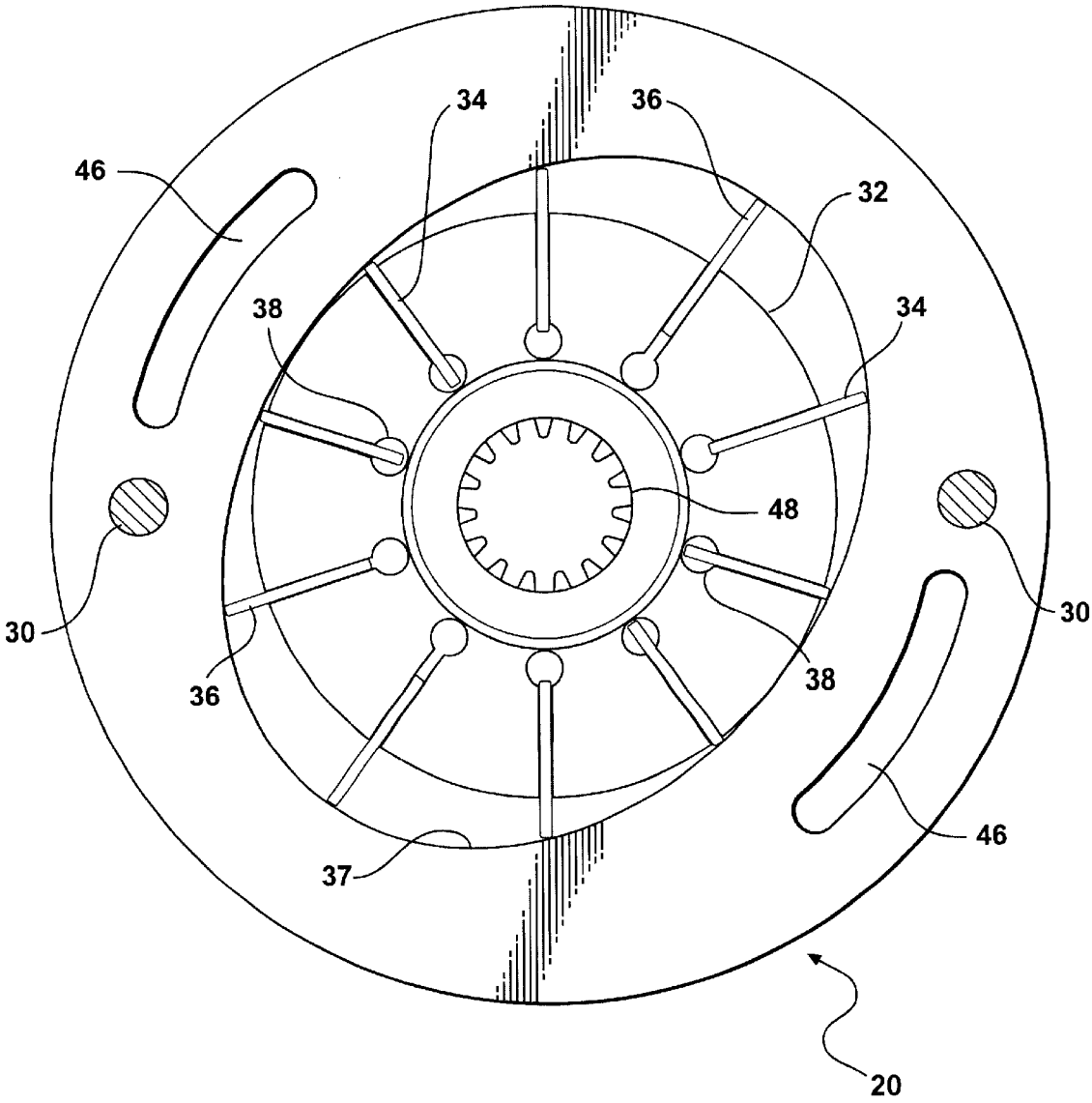
FIG. 3 is a sectional view taken along lines 3—3 of FIG. 1.

As best seen in FIG. 3, each vane slot 34 extends radially inwardly sufficient for providing a space 38 for fluid under the vane. The thrust plate 18 and pressure plate 22 cooperate with the rotor and cam ring 20 to define the axial extent of the fluid chambers formed between adjacent vane members 36.

The thrust plate 18 has a pair of diametrically opposed inlet ports 39 and a pair of diametrically opposed discharge ports 40. The discharge ports 40 are recessed ports only and preferably do not extend entirely through the width of the thrust plate 18. The inlet ports 39 are angularly offset from the discharge ports 40.

Similarly, the pressure plate 22 includes a pair of diametrically opposed inlet ports 42 and a pair of diametrically opposed discharge ports 44. The inlet ports 42 are angularly offset from the discharge ports 44. The inlet ports 42 on the pressure plate 22 are axially aligned with the inlet ports 39 on the thrust plate 18. Similarly, the discharge ports 44 on the pressure plate 22 are axially aligned with the discharge ports 40 on the thrust plate 18. The discharge ports 40 and 44 are also in fluid communication through a pair of apertures 46 in the cam ring 20 (FIG. 3). As shown, the apertures 46 comprise elongated slots extending through the cam ring 20. It will be appreciated that the apertures 46 may take any configuration which allows for fluid communication between the discharge ports 40, 44.

The hold-down spring 24 creates a sufficient force to maintain the pressure plate 22, cam ring 20 and thrust plate 18 in the abutting relationship shown in FIG. 1. The dowel pins 30 prevent relative rotation between these members. The rotor 32 has a central spline portion 48 which is drivingly connected to a drive shaft 50 adapted to be driven by a source of motive power such as an internal combustion engine.

The drive shaft 50 rotates about a longitudinal axis. As the drive shaft 50 rotates, the rotor 32 rotates, causing the chambers between adjacent vanes 36 to expand and contract in a well-known manner. Fluid will enter between adjacent vanes 36 when aligned with inlet ports 39 and 42 and will be discharged when adjacent vanes 36 are aligned with discharged ports 40 and 44. The discharge ports 40 and 44 are open to the space between pressure plate 22 and end cap 26. The fluid communication between the ports 40 and 44 to the open space between the pressure plate 22 and end cap 26 is through a pair of schematically represented passages 57 in the pressure plate.

Fluid in the space is discharged through a passage 52 to a conventional flow control and pressure regulator valve 54 which permits a predetermined about of fluid to be delivered from the pump to a discharge port, not shown, while the remainder of the fluid returns to the inlet ports 38 and 42 through a passage 56. The operation of the flow control valve 54 is well known.

As the vanes 34 pass adjacent the inlet ports 39 and 42, they extend to the greatest radial degree. In this inlet area, the fluid is at its relatively lowest pressure. As the rotor 32 rotates in the direction of the arrow "A" on FIG. 3 from the inlet area, the vanes 36 are forced radially inwardly within the slot 34. This effectively reduces the area of the fluid chamber defined between adjacent vanes 36, causing the fluid within the chamber to reach a relatively higher pressure.

The fluid disposed in the vane slots 34 on the underside of the vanes 36 in the space 38 also undergoes a pumping action. The fluid under the vanes 36 in the discharge area or quadrant, that is, the vanes passing adjacent ports 40 and 44, is forced from under the vanes because the vanes 36 are receding into the slots 34. Simultaneously, the vanes 36 in the inlet area or quadrant, that is, the vanes 36 passing adjacent inlet ports 39 and 42, are extending thereby providing a space which must be filled with fluid.

Figure 4:
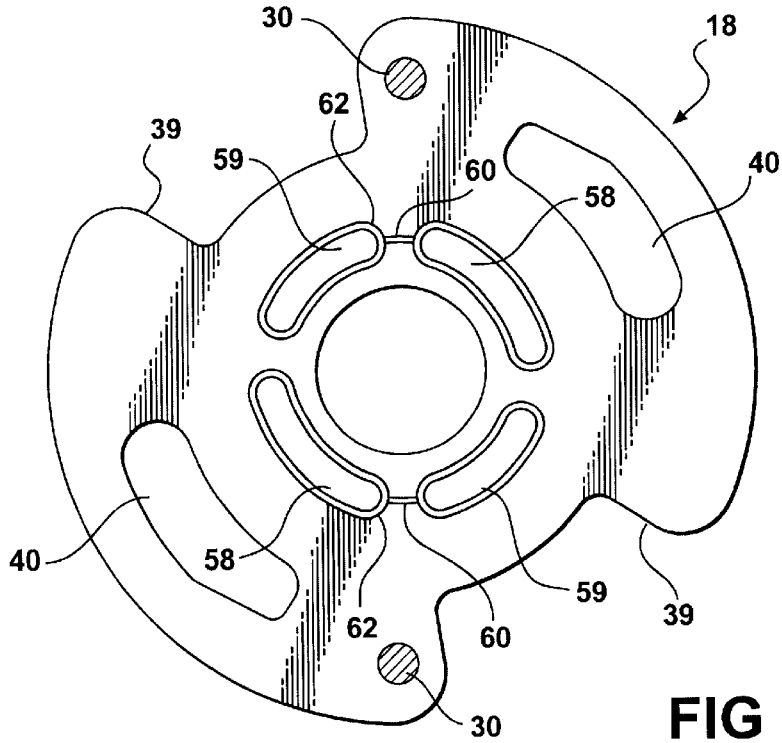
FIG. 4 is a sectional view taken along lines 4—4 of FIG. 1.

To communicate the fluid from under the vanes 36 in the discharge quadrant to under the vanes 36 in the inlet quadrant, fluid passageways in both the thrust plate 18 and pressure plate 22 are provided. As best seen in FIG. 4, there is a pair of passageways in the first or thrust plate 18. Each passageway in the thrust plate 18 comprises two generally kidney-shaped passageways 58, 59. The first kidney-shaped passageway 58 is aligned in the radial direction with the discharge port 40. The second kidney-shaped passageway 59 is aligned in the radial direction with the inlet passage 39. The passageways 58 and 59 are axially aligned with the radially inner end of the slots 34. The generally kidney-shaped passageways and 58 and 59 do not extend through the width of the thrust plate 18. Rather, each of the passageways comprise a groove in the thrust plate 18.

Adjacent pairs of associated passageways 58, 59 are connected at one adjacent end by a restriction passage or metering groove 60. The restriction passage or metering grooves 60 are used for pressure control in the discharge or high-pressure under-vane area and allow excess fluid to flow to the inlet or low-pressure area. The passageways 58, 59 are further blocked from communicating with one another at their opposite adjacent end. This blockage creates an under-vane pump within the pump 10 and can best be described as separating the low-to-high pressure transition of the thrust plate 18. By closing the low-to-high pressure transition in the plates, a controlled volume of fluid is maintained in the high-pressure under-vane region. this trapped volume of fluid is used to increase the pressure at the under-vane area because the fluid is not allowed to flow back to the low-pressure area. As stated above, because the fluid being pumped in non-compressible, as the vanes 36 sweep through the high-pressure region, the volume is decreased in the under-vane area. In previous designs, once the vanes reached the high-pressure region, the discharge pressure was greater than the intake pressure, which caused the vane to slide back in the slots and leave the inner surface of the pressure plate 22. By blocking the area of the thrust plate set forth above, the high-pressure fluid is not allowed to pass to the low-pressure area by overcoming the vane force.

The pressure plate 22 has a plurality of kidney-shaped passages 66, 68 axially aligned with the passages 59, 58 of the thrust plate 18. Each passage 66, 68 is isolated from the adjacent such passage such that they do not communicate with one another. The passages 66, 68 are preferably formed as depressions or grooves in the face of the pressure plate 22 and thus do not extend fully through the pressure plate. The passages 66, may include an opening or port 69 communicating with the space 16 and axially aligned with the passages 58 of the thrust plate 18.

It is also noted that the thrust plate blockage preferably coincides with the blockage in the pressure plate 22, as set forth above. The thrust plate blockage or isolation, as set forth above, terminates at the beginning of the metering groove or restriction passage 62 prior to discharge.

One style vane pump 10 has been discussed above and shown in the drawings. It will be appreciated that within the scope of the present invention, any configuration for the vane pump may be used.

The invention has been described in an illustrative manner as to be understood that the terminology which has been used is intended to be in the nature of words of description rather than of limitation. Obviously, many modifications and variations of the present invention are possible in light of the above teachings. It is to be understood that the invention may be practiced otherwise as is specifically claimed.

What is claimed is:

1. A vane pump comprising:

a housing;

a ported first plate seated on said housing and having a pair of first plate passageways thereon, a ported second plate having a pair of second plate passages thereon and a cam ring disposed between said first and second plates;

an oval-shaped wall on said cam ring cooperating with said plates to define a rotor chamber;

a rotor supported in said rotor chamber for rotation about a longitudinal axis;

a plurality of radial vane slots in said rotor, each vane slot defining an undervane cavity, said first plate passageways and said second plate passages being axially aligned with said undervane cavities;

a plurality of flat vanes slideable in respective ones of said vane slots; and each of said first plate passageways including two generally kidney-shaped passageways joined by a restricted passage with each of said kidney-shaped passageways being isolated from fluid communication with the next adjacent kidney-shaped passageway on said first plate, each of said second plate passages including at least two generally kidney-shaped passages in said second plate with said second plate passages being isolated from fluid communication with the next adjacent kidney-shaped passage in said second plate in the direction of rotation of said rotor.

2. A vane pump as set forth in claim 1 wherein said first plate includes an inlet port and a discharge port, the first of said kidney shaped passageways in said first plate being radially aligned with said discharge port, the second of said kidney shaped passageways in said first plate being radially aligned with the inlet port, and said restricted passage connected between said first and second kidney shaped passageways.

3. A vane pump as set forth in claim 2 wherein said second plate includes an inlet port and outlet port, said kidney-shaped passage in said second plate being radially aligned with said inlet port and said outlet port therein in the direction of rotation of said rotor.

4. A vane pump as set forth in claim 3 wherein said first plate, said cam ring and said second plate are maintained in axial and angular alignment by at least a pair of dowel pins, said dowel pins also being secured to said housing.

5. A vane pump as set forth in claim 4 further including an end cap secured to said housing.

6. A vane pump as set forth in claim 5 further including a hold-down spring operative between said end cap and said second plate, to maintain said second plate, said cam ring and said first plate in abutting relationship.

7. A vane pump as set forth in claim 6 further including a drive shaft operatively connected to said rotor for imparting rotational movement to said rotor.

8. A vane pump comprising:

a housing;

a rotating group including a ported first plate seated on said housing and having a pair of passageways thereon, a ported second plate having a pair of passages thereon, and a cam ring disposed between said second plate and said first plate;

an oval-shaped wall on said cam ring cooperating with said second plate and said first plate to define a rotor chamber in said rotating group;

a rotor supported in said rotor chamber for rotation about a longitudinal axis of said vane pump;

a plurality of radial vane slots in said rotor, each vane slot defining an undervane cavity, said passageways and said passages being axially aligned with said undervane cavities;

a plurality of flat vanes slideable in respective ones of said vane slots; and wherein each of said passageways includes two generally kidney-shaped passages joined by a restricted passage and wherein each of said passageways is isolated from fluid communication with the next adjacent passageway on said first plate;

said first plate including an inlet Port and a discharge port, the first of said kidney shaped passages being radially aligned with said discharge port, the second of said kidney-shaped passages being radially aligned with the inlet port, and said restricted passage being connected between said first and second kidney-shaped passages;

said passageway being isolated from fluid communication with the next adjacent passageway in the direction of rotation of said rotor in the low-to-high pressure transition of said first plate;

said passages each comprising a kidney-shaped passage in said second plate;

said second plate including an inlet port and an outlet port, each said kidney-shaped passage being radially aligned with said inlet port on said outlet port in the direction of said rotor;

each said passage in said second plate being isolated from fluid communication with the next adjacent passage in said second plate in the direction of rotation of said rotor between an area adjacent said discharge port of a first of said passages in said second plate and an area adjacent said inlet port of a second of said passages in said second plate.

9. A vane pump as set forth in claim 8 wherein said kidney shaped passages do not extend through said second plate.

10. A vane pump as set forth in claim 9 wherein at least one of said kidney shaped passages includes a port extending through said second plate.

* * * * *